US009079196B2

(12) United States Patent
Sandahl et al.

(10) Patent No.: US 9,079,196 B2
(45) Date of Patent: Jul. 14, 2015

(54) MULTIPLE SPRAY TIP TURRET ASSEMBLY FOR PAINT SPRAYER

(75) Inventors: Jeffrey E. Sandahl, Buffalo, MN (US); Joseph W. Kieffer, Chanhassen, MN (US); Timothy J. Wessels, Victoria, MN (US); Viktor Sorg, Salem (DE); Michael B. Jones, Excelsior, MN (US); Terry Reents, Lakeville, MN (US)

(73) Assignee: WAGNER SPRAY TECH CORPORATION, Plymouth, MN (US)

( * ) Notice: Subject to any disclaimer, the term of this patent is extended or adjusted under 35 U.S.C. 154(b) by 224 days.

(21) Appl. No.: 13/519,038

(22) PCT Filed: Mar. 11, 2010

(86) PCT No.: PCT/US2010/027026

§ 371 (c)(1),
(2), (4) Date: Jun. 25, 2012

(87) PCT Pub. No.: WO2011/112196

PCT Pub. Date: Sep. 15, 2011

(65) Prior Publication Data

US 2012/0280066 A1 Nov. 8, 2012

(51) Int. Cl.

| | |
|---|---|
| ***A62C 31/02*** | (2006.01) |
| ***B05B 9/01*** | (2006.01) |
| ***B05B 1/16*** | (2006.01) |
| ***B05B 15/02*** | (2006.01) |
| *B05B 15/06* | (2006.01) |

(52) U.S. Cl.

CPC . *B05B 9/01* (2013.01); *B05B 1/169* (2013.01); *B05B 1/1672* (2013.01); *B05B 15/0283* (2013.01); *B05B 15/061* (2013.01)

(58) Field of Classification Search

USPC ..... 422/540; 604/167.05; 222/153.01; 239/436–449, 548–568

See application file for complete search history.

(56) References Cited

U.S. PATENT DOCUMENTS 3,116,882 A * 1/1964 Vork ..... 239/119
3,414,196 A 12/1968 Legeza et al.

(Continued)

FOREIGN PATENT DOCUMENTS

CN 2369775 Y 3/2000

OTHER PUBLICATIONS

International Search Report and Written Opinion for PCT Application No. PCT/US2010/027026, dated Dec. 6, 2010, 11 pages.

(Continued)

*Primary Examiner* — Len Tran
*Assistant Examiner* — Adam J Rogers
(74) *Attorney, Agent, or Firm* — Christopher J. Volkmann; Kelly, Holt & Christenson, PLLC

(57) ABSTRACT

A reversible, multiple spray tip spray gun tip assembly includes a tip holder and a turret. In one embodiment, the tip holder has a turret opening and a fluid spray passage that is in communication with the turret opening. The turret has a barrel including a plurality of spaced apart spray tips and a handle to rotate the barrel within the turret opening. Either the tip holder or the turret includes one or more projections while the other of the tip holder or the turret includes a cam surface with which the one or more projections slideable engage such that rotating the turret relative to the tip holder causes the turret to translate relative to the tip holder and to align each of the spray tips with the fluid spray passage in a spray position and a clear position.

21 Claims, 15 Drawing Sheets

(56) References Cited

U.S. PATENT DOCUMENTS

| | | | | |
|---|---|---|---|---|
| 4,516,724 | A * | 5/1985 | Hellman | 239/119 |
| 4,903,719 | A * | 2/1990 | Rains | 137/15.17 |
| 6,502,763 | B1 | 1/2003 | McCann | |
| 6,655,606 | B2 | 12/2003 | Earl | |
| 7,178,546 | B2 * | 2/2007 | Gremillion, III | 137/15.01 |
| 2003/0010838 | A1 * | 1/2003 | Earl | 239/104 |

OTHER PUBLICATIONS

First Office Action from Chinese Counterpart Application No. 201080065269.8, issuing date: Aug. 11, 2014. 15 pages with English Translation.

* cited by examiner

MULTIPLE SPRAY TIP TURRET ASSEMBLY FOR PAINT SPRAYER

CROSS-REFERENCE TO RELATED APPLICATION(S)

The present application is a Section 371 National Stage Application of International Application No. PCT/US2010/027026, filed Mar. 11, 2010, which is incorporated by reference in its entirety and published in English as WO2011/112196 on Sep. 15, 2011.

TECHNICAL FIELD

The present disclosure relates to paint sprayers including reversible paint spray turrets carrying one or more atomizing tips for spraying paint and similar coating materials, along with a holder for such a turret.

BACKGROUND

Paint spray guns having reversible spray turret and holder assemblies include a turret having one or more paint spray tips. In turrets having more than one paint spray tip, a user typically urges the turret longitudinally with respect to the holder in order to align a desired paint spray tip. A paint spray tip may be aligned for either spraying or cleaning.

One example of such an arrangement is U.S. Pat. No. 5,255,848 to Rhodehouse for a multiple orifice spray device. U.S. Pat. No. 6,655,606 to Earl relates to a multiple nozzle tip assembly with nozzles all aligned in the same radial direction and axially displaced along the cylindrical shaft. U.S. Pat. No. 6,502,763 to McCann has a turret with two orifice members mounted in parallel transverse bores in a cylindrical body.

SUMMARY

One embodiment of the invention is a reversible, multiple spray tip spray gun tip assembly that includes a tip holder and a turret. In one embodiment, the tip holder has a turret opening and a fluid spray passage that is in communication with the turret opening. The turret has a barrel including a plurality of spaced apart spray tips and a handle to rotate the barrel within the turret opening. Either the tip holder or the turret includes one or more projections. The other of the tip holder or the turret includes a cam surface with which the one or more projections slideable engage such that rotating the turret relative to the tip holder causes the turret to translate relative to the tip holder and to align each of the spray tips with the fluid spray passage in a spray position and a clear position.

In some embodiments, the cam surface is on the tip holder and the one or more projections are on the turret. The tip holder may include a base and a cam ring that engages the base. The cam surface is on the cam ring. In other embodiments, the tip holder includes a base and a cam clamp that extends around and engages the base. The cam surface is on the cam clamp in this embodiment. In still other embodiments, the turret includes the cam surface and the one or more projects are on the tip holder.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

One embodiment of the invention pertains to a turret and tip holder assembly that enables a user to apply a rotational force to the turret to move and guide the turret both rotationally and longitudinally with respect to the tip holder to properly position a selected one of two or more alternative tips in the turret for spraying or cleaning. FIGS. 1 through 8 illustrate an embodiment of the invention in which the turret includes a projection and the tip holder includes structure providing the corresponding cam surface with which the projection interacts.

Figure 1:
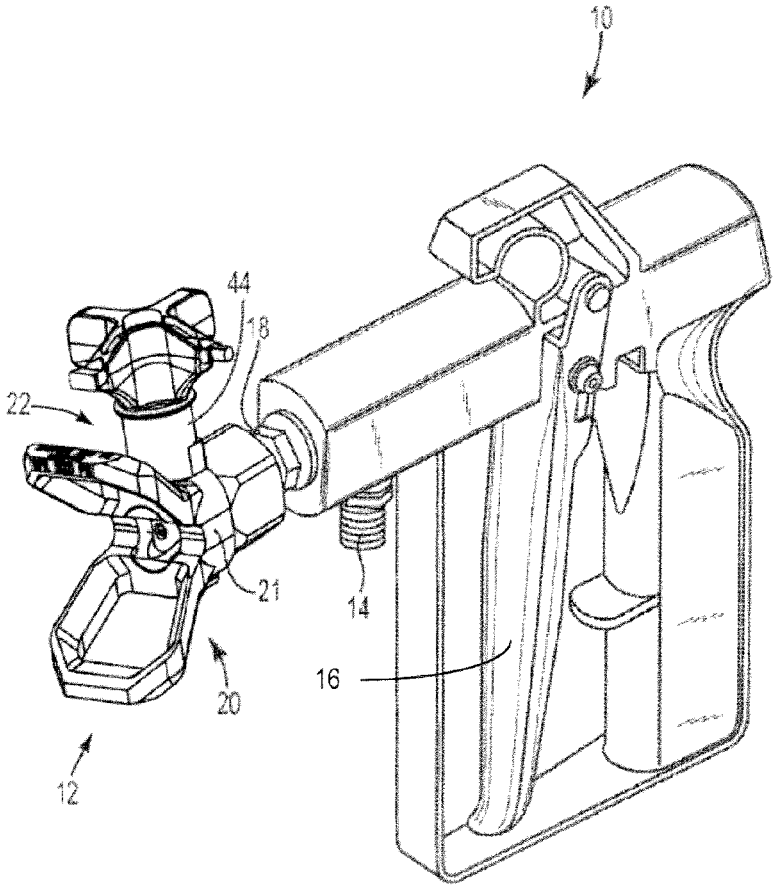
FIG. 1 is a perspective view of a paint spray gun with a tip holder and turret assembly according to an embodiment of the invention.

FIG. 1 is a perspective view illustrating a paint spray gun 10 that includes a tip assembly 12 according to an embodiment of the invention. In some embodiments, as illustrated, the paint spray gun 10 is configured for use with an airless paint spray pump (not illustrated) to atomize paint that is pressurized by the pump and delivered to the paint spray gun 10 via a high pressure hose (not illustrated) to an inlet fitting 14. A trigger 16 may be used to actuate the paint spray gun 10, causing paint to flow from the inlet fitting 14 to an outlet fitting 18 where it is delivered to the tip assembly 12 which includes an orifice to atomize the paint sprayed by the assembly shown in FIG. 1. The tip assembly 12 may include a tip holder 20 and a turret 22. In this embodiment, the tip holder 20 includes a base 21 and a cam ring 44.

The tip holder 20 and the turret 22 include structure that permits the turret 22 to be rotated relative to the tip holder 20 and in turn cause the turret 22 to translate relative to the tip holder 20 and thereby align each of a plurality of spray tips located in the turret 22 with a fluid spray passage within the tip holder 22. Each of the spray tips may be aligned in either a spray position or a clear position, as desired. In some cases, one of the tip holder 20 and the turret 22 will include one or more projections that engage with a cam surface on the other of the tip holder 20 and the turret 22. In the embodiment illustrated in FIG. 1, the tip holder 20 includes a cam ring 44. Other Figures will illustrate other embodiments of the engagement between the tip holder 20 and the turret 22.

Figure 2:
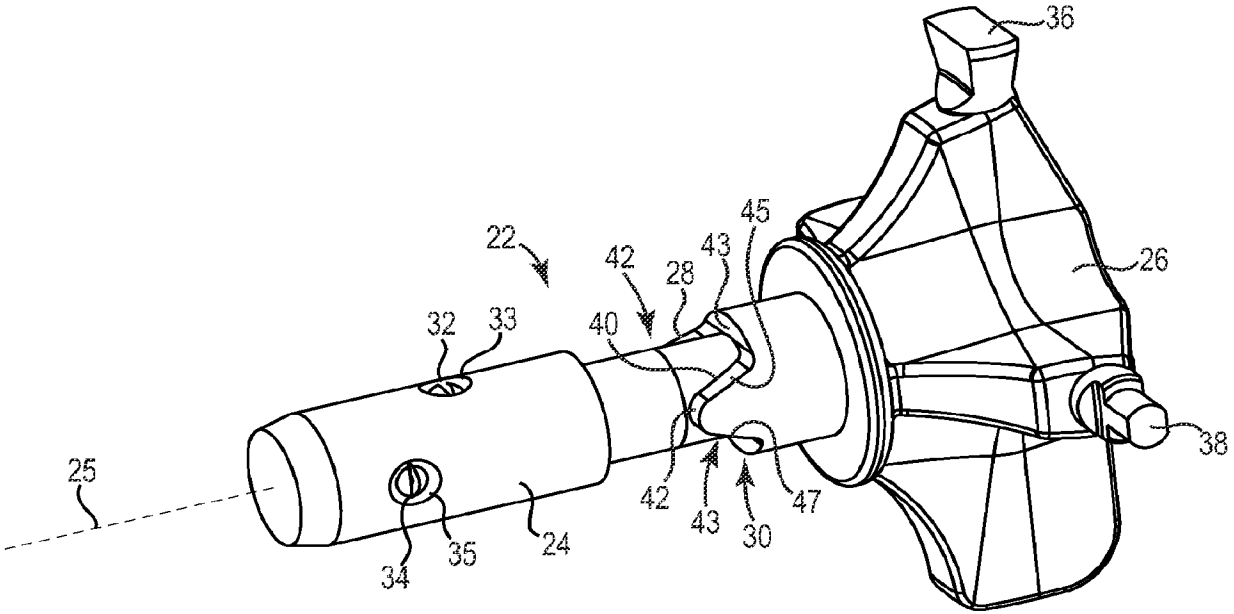
FIG. 2 is a perspective view of a turret portion of the turret assembly of FIG. 1.

FIG. 2 is a perspective view of the turret 22 according to an embodiment of the invention. The turret 22 includes a barrel 24, a handle 26 and an intermediate section 28. In some embodiments, the barrel 24 and the intermediate section 28 are integrally formed. In some instances, the barrel 24 and the intermediate section 28 are separately formed and subsequently joined together. The intermediate section 28 includes a raised surface or projection 30 that, as discussed subsequently, interacts with a corresponding surface in or attached to the tip holder 20.

As illustrated, the barrel 24 includes a first spray tip 32 and a second spray tip 34. The first spray tip 32 is disposed within a bore 33 extending through the barrel 24. The second spray tip 34 is disposed within a bore 35 extending through the barrel 24. In some embodiments, the first spray tip 32 and/or the second spray tip 34 may be replaceable within their respective bores 33, 35.

The first spray tip 32 and the second spray tip 34 are axially spaced apart along a longitudinal axis 25 within the barrel 24 and moreover are radially spaced apart as well. As illustrated, the first spray tip 32 and the second spray tip 34 are arranged about 90 degrees apart. In some embodiments, the barrel 24 may include three or more distinct spray tips, each of which may be axially and radially spaced apart from one another. In some cases, each spray tip may provide a different spray pattern. In some embodiments, each spray tip may provide the same spray pattern, but function to provide one or more spare spray tips that can be used if another spray tip has become worn or clogged.

In some embodiments, the handle 26 may include indicia that provides the user with a visual confirmation of which spray tip is positioned for use. For example, the first spray tip 32 may provide a relatively narrow spray pattern while the second spray tip 34 may provide a relatively wide spray pattern. In some instances, the first spray tip 32 may for example provide a spray pattern that is roughly rectangular in shape while the second spray tip 34 may provide a spray pattern that is roughly circular in shape.

In the illustrated embodiment, the handle 26 includes a first marker 36 that is aligned with the first spray tip 32 as well as a second marker 38 that is aligned with the second spray tip 34. As shown, the first marker 36 has a different shape than the second marker 38 in order to distinguish between alignment of the first spray tip 32 and the second spray tip 34. It will be appreciated that the first spray tip 32 and the second spray tip 34 may have a clear position in which the spray tip is aligned 180 degrees from its spray position in order to clear blockages from the spray tip. In this instance, it will be appreciated that when a particular spray tip is in its clear position, the corresponding marker on the handle 26 will also be arranged 180 degrees from its spray position.

In some embodiments, as illustrated, the projection 30 may be formed as a raised shoulder 40 that stands above the intermediate section 28 and is integrally formed with or otherwise attached to the intermediate section 28. In the illustrated embodiment, the raised shoulder 40 may be seen as including a pair of high points 42 that are located about 180 degrees apart and a pair of low points 43 that are equally spaced between the pair of high points 42. In between the high points 42 and the low points 43, the projection 30 may include angled ramps disposed at an angle relative to the longitudinal axis 25 that may range from about 0 to about 90 degrees. In some embodiments, the projection 30 may include (on the visible side of the turret 22 as seen in FIG. 2), a first angled ramp 45 and a second angled ramp 47 that each extend from a common high point 42 towards the two low points 43 that are spaced apart on the turret 22. In some embodiments, the projection 30 may instead be fanned via a pair of raised tabs or projections extending from the intermediate section 28, rather than the raised shoulder illustrated herein.

Figure 3A:
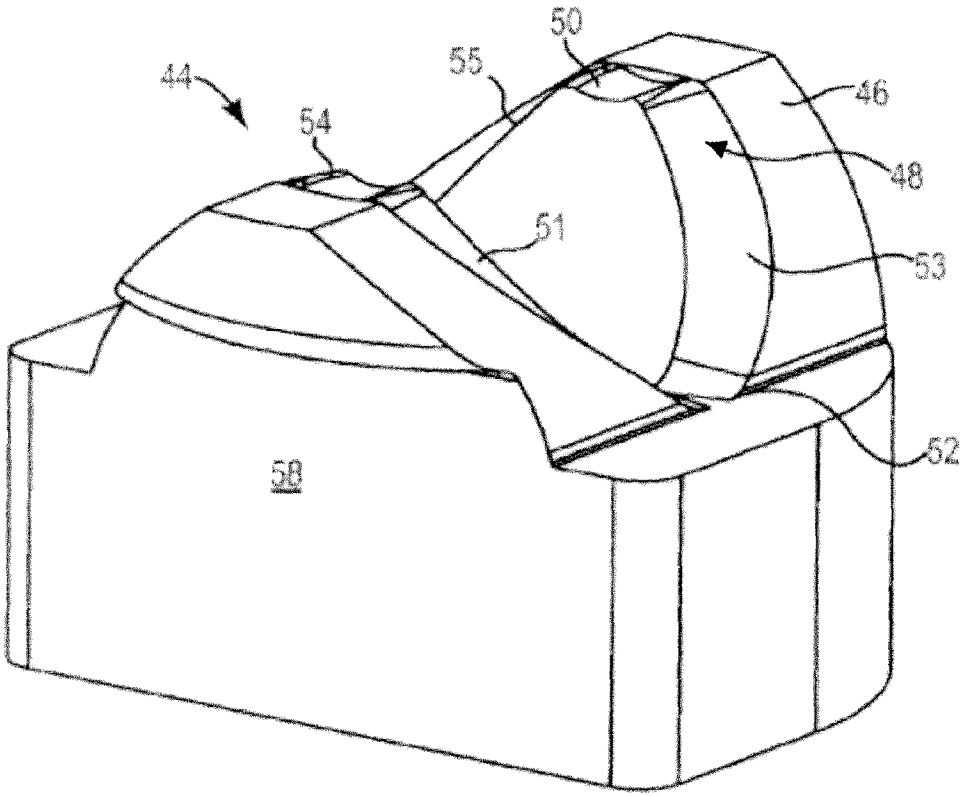
FIGS. 3 A and 3B are partial cutaway views of an adaptor ring portion of the turret assembly of FIG. 1.
Figure 3B:
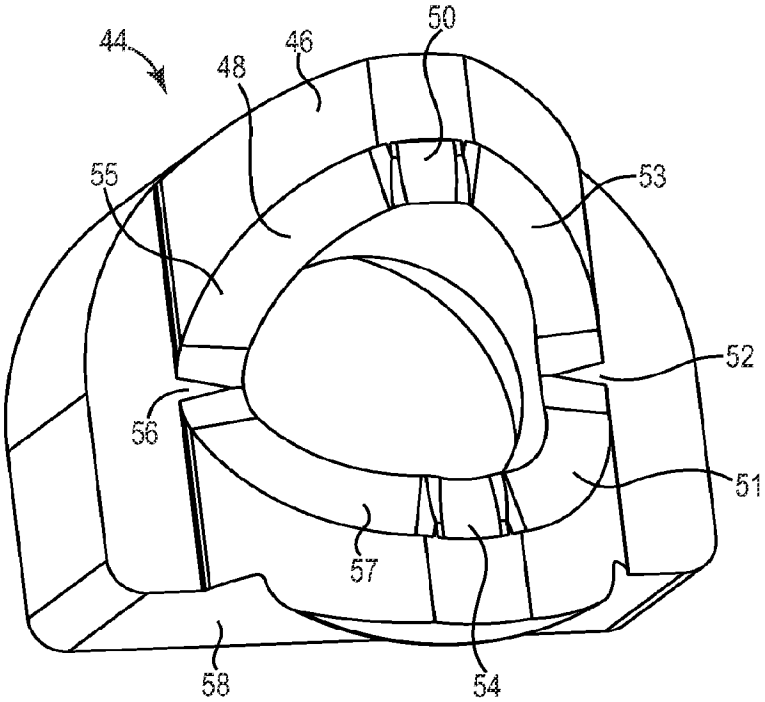

FIGS. 3A and 3B are perspective views of the cam ring 44. As illustrated in FIG. 1 and as will be discussed subsequently, the turret 22 may be disposed within the cam ring 44. In the illustrated orientation, the upper portion of the cam ring 44 will, in use, he closest to the handle 26 of the turret 22. The cam ring 44 includes an annular wall 46 that has been partially cut away to illustrate internal components of the cam ring 44. The cam ring 44 includes a cam surface 48 that extends between a first high point 50, a first low point 52, a second high point 54 and a second low point 56.

In between the high points 50, 54 and the low points 52, 56, the cam surface 48 may form angled ramps disposed at an angle that may range from about 0 to about 90 degrees. In the illustrated embodiment, an angled ramp 51 extends between the low point 52 and the high point 54. An angled ramp 53 extends between the low point 52 and the high point 50. An angled ramp 55 extends between the low point 56 and the high point 50. An angled ramp 57 extends between the low point 56 and the high point 54. In some embodiments, the cam ring 44 may include stop structures to releasably position the turret 22. In the illustrated embodiment, the cam ring includes detents or recesses formed in either the high points 50, 54 or the low points 52, 56.

In comparing the turret 22 (as shown in FIG. 2) to the cam ring 44 (as shown in FIGS. 3A and 3B), it will be appreciated that rotating the turret 22 relative to the cam ring 44 may result in relative axial movement between the turret 22 and the cam ring 44 as the projection 30 interacts with the cam surface 48. If, for example, the high points 42 of the projection 30 are disposed within the detents formed in the high points 50 and 54 of the cam surface 48, the turret 22 will be in a first axial outer position in which the turret 22 is relatively spaced apart from the cam ring 44. If the turret 22 is rotated 90 degrees such that the high points 42 of the projection 30 are disposed within the detents formed in the low points 52 and 56 of the cam surface 48, the turret 22 will be in second axial position in which the turret 22 is relative spaced closer to the cam ring 44.

It will be appreciated that the illustrated turret 22 has two inner axial positions and two outer axial positions, each of which are about 90 degrees apart. For example, rotating the turret 22 about 90 degrees in a first direction moves the barrel 24 between a spray position for the first spray tip 32 to a spray position for the second spray tip 34. Rotating the turret 22 in a second, opposite, direction moves the barrel 24 between a spray position for the first spray tip 32 and a clean position for the second spray tip 34. Rotating the turret 22 in a second direction moves the barrel 24 between a clean position for the second spray tip 34 to a clean position for the first spray tip 32.

In some embodiments, the cam ring 44 is configured to engage with the tip holder 20. In the illustrated embodiment, the cam ring 44 has an overall diameter that fits into an opening (axially aligned with the turret opening) formed within the tip holder 20 as well as a flat surface 58. The flat surface 58 may, as discussed with respect to subsequent Figures, interact with the tip holder 20 to eliminate or at least substantially reduce rotation of the cam ring 44 relative to the tip holder 20. In some embodiments, the cam ring 44 and turret 22 are configured such that the cam ring 44 may be used in combination with an existing paint spray gun that otherwise is configured to accommodate a turret having a single spray tip. This permits a user to provide the functionality of multiple spray tips without having to purchase a new paint gun or a new tip holder.

Figure 4:
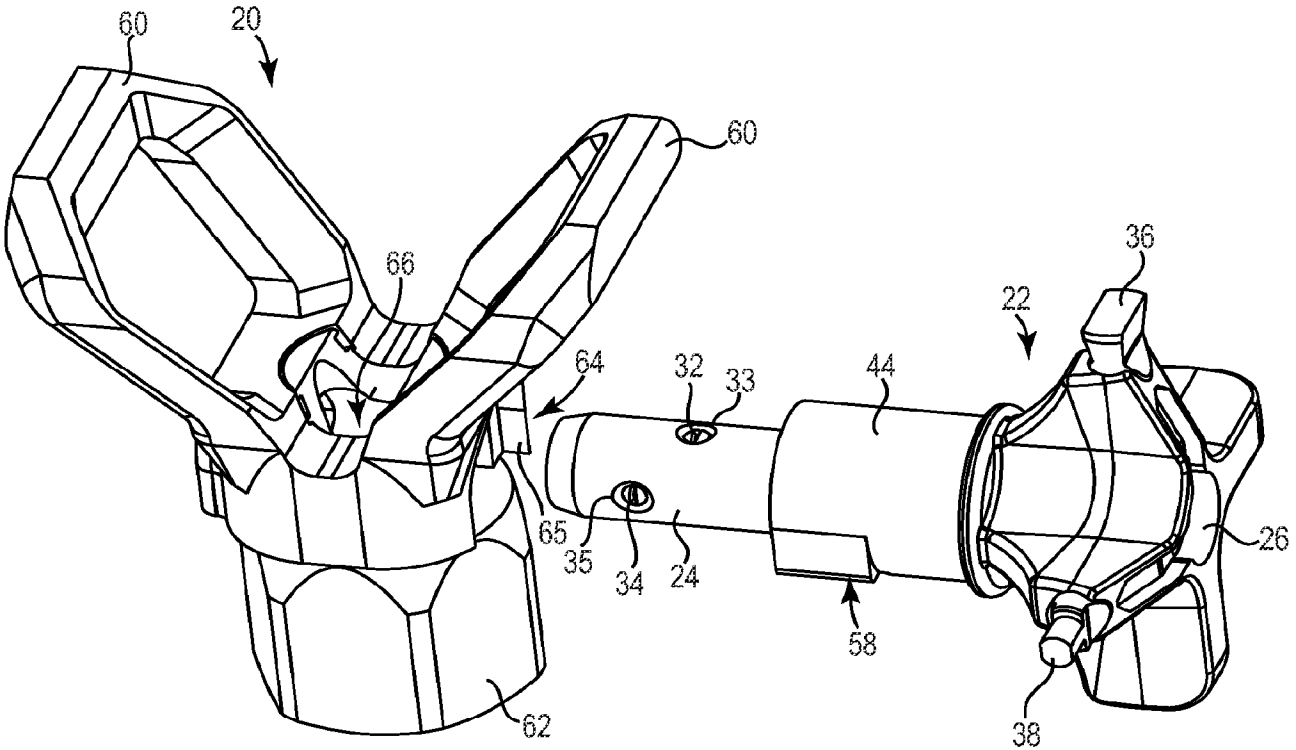
FIG. 4 is a perspective exploded view of the tip holder and turret assembly of FIG. 1.

FIG. 4 is an exploded perspective view of the tip holder 20 and the turret 22. In this illustration, the turret 22 extends through the cam ring 44. In some embodiments, the turret 22 is configured such that it can just be extended into and through the cam ring 44. In some instances, the barrel 24 may be too wide to permit extension through the cam ring 44, and instead the turret 22 may be formed in two parts that are each extended into the cam ring 44 from opposite directions and joined together therein.

In some embodiments, the tip holder 20 is largely formed of a polymeric material and includes a pair of guards 60. A rotatable attachment nut 62 permits the tip holder 20 to be threadedly engaged with the outlet fitting 18. A turret opening 64 extends through the tip holder 20 and is configured to accommodate the turret 22. A larger aperture 65 is axially aligned with the turret opening 64 and is sized to accommodate the cam ring 44. In some embodiments, the larger aperture 65 may be configured to accommodate conventional turrets that include structure that limit rotation relative to the larger aperture 65.

In use, paint enters the tip holder 20 through the outlet fitting 18 and passes through one of the spray tips 32, 34. A fluid spray passage 66 may be considered as extending axially through the tip holder 22. In some embodiments, as illustrated, the fluid spray passage 66 may be considered as being perpendicular or at least substantially perpendicular to the turret opening 64.

Figure 5:
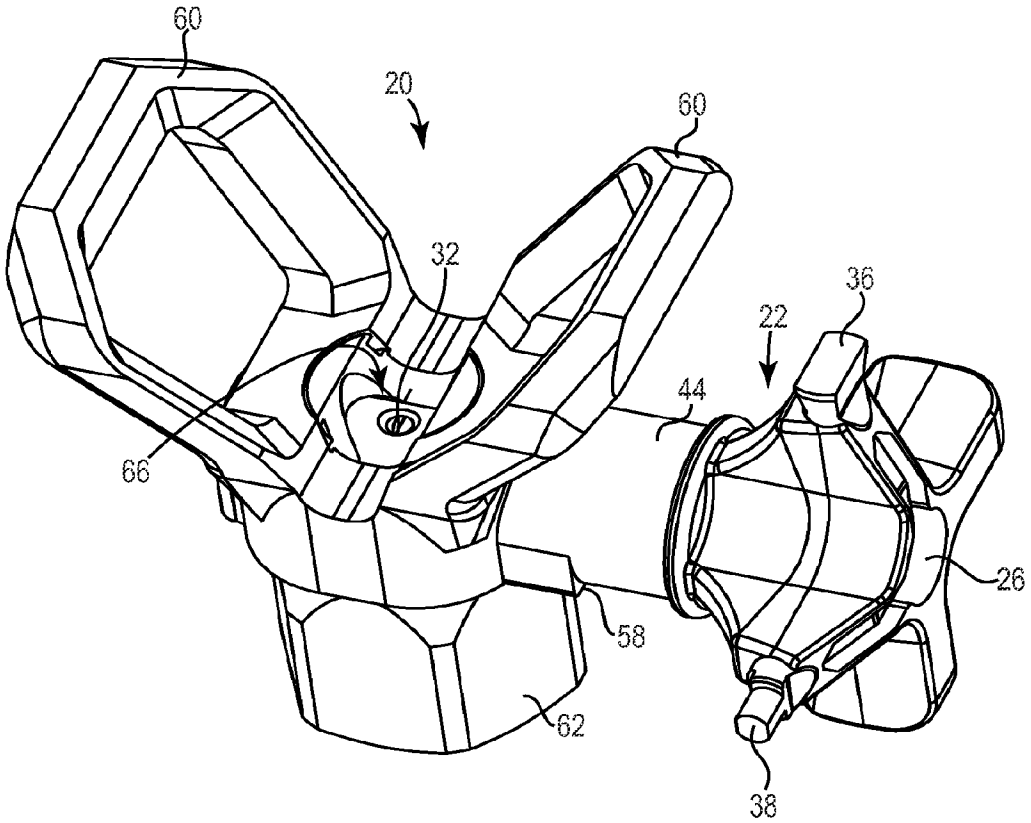
FIG. 5 is a perspective assembled view of the tip holder and turret assembly of FIG. 1 with the turret assembly in a first position.

FIG. 5 is a perspective view of the tip holder 20 and the turret 22, showing the turret 22 in an inner position in which the first spray tip is aligned with the fluid spray passage 66. It can be seen, in comparison with FIG. 4, that the cam ring 44 extends partially into the larger aperture 65 and that the flat surface 58 of the cam ring 44 engages with a shoulder 72 (sec FIG. 6) of the rotatable attachment nut 62, thereby preventing or substantially preventing rotation of the cam ring 44 relative to the tip holder 20.

Figure 6:
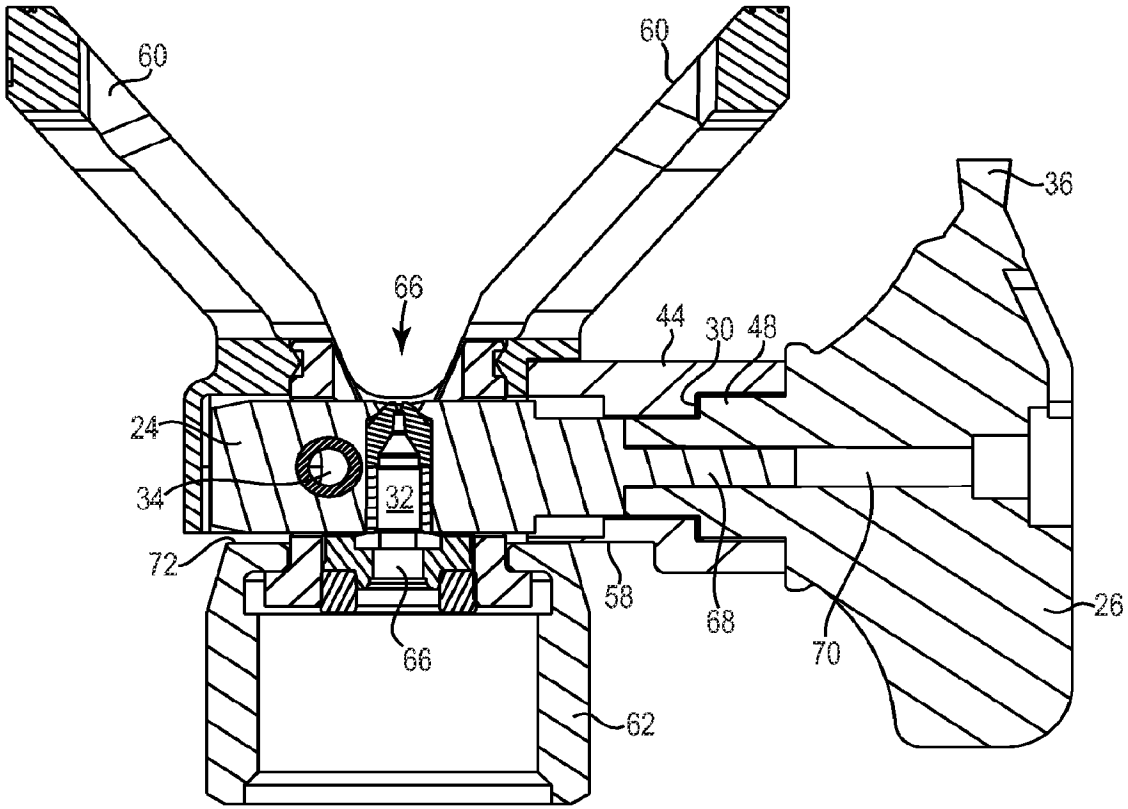
FIG. 6 is a cross-sectional view of the tip holder and turret assembly in the position shown in FIG. 5.

FIG. 6 is a cross-sectional view taken along line 6-6 of FIG. 5. In this view, it can be seen that this embodiment of the turret 22 is formed of two distinct portions. The barrel 24 includes a securement extension 68 that is configured to fit snugly into a securement aperture 70 that is formed within the intermediate section 28 and the handle 26. It will be appreciated that this permits assembly of the turret 22 within the cam ring 44.

Figure 7:
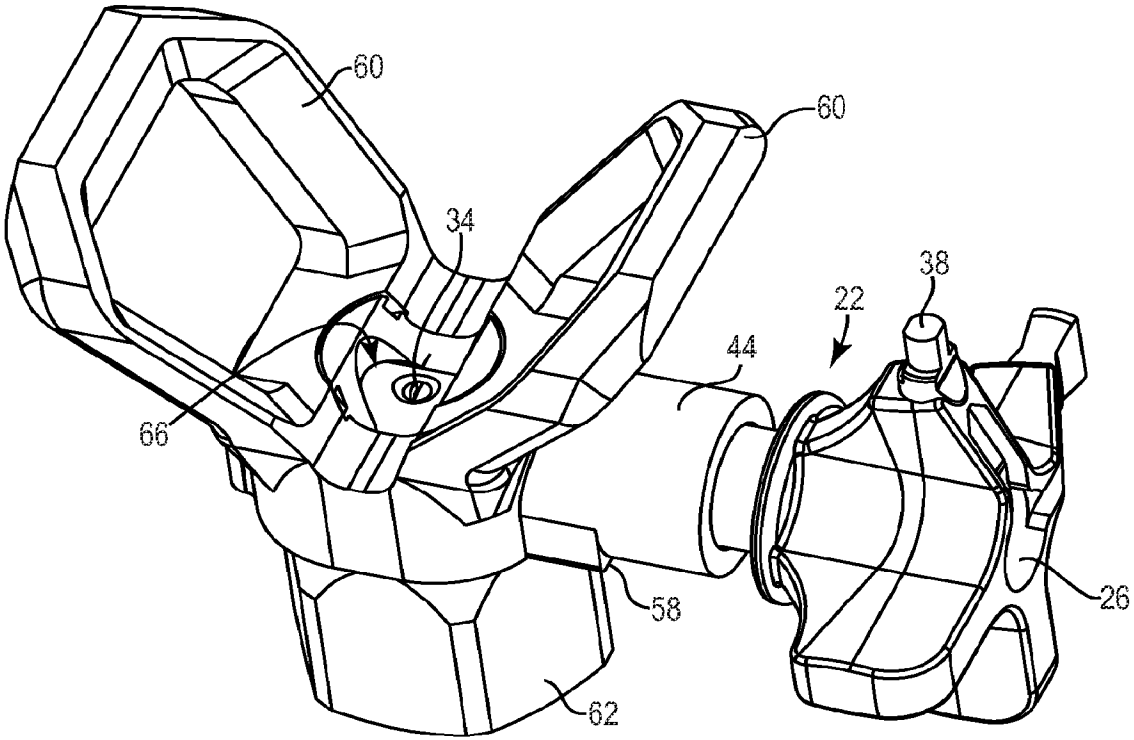
FIG. 7 is a perspective assembled view of the tip holder and turret assembly of FIG. 1 with the turret assembly in a second position.
Figure 8:
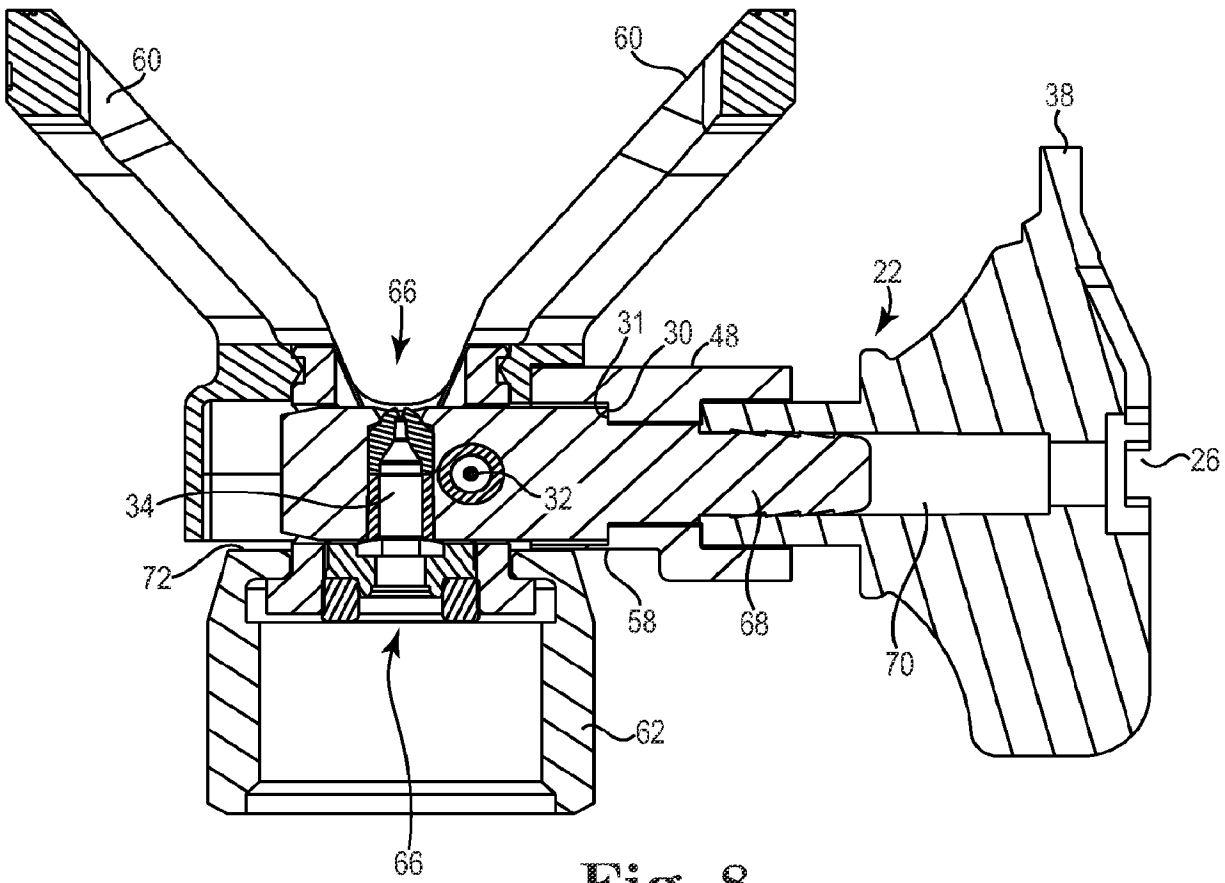
FIG. 8 is a cross-sectional view of the tip holder and turret assembly in the position shown in FIG. 7.

FIG. 7 is a perspective view of the tip holder 20 and the turret 22, with the turret 22 in an outer position in which the second spray tip 34 is aligned with the fluid spray passage 66. It can be seen that, in comparison to FIG. 5, the turret 22 is farther away from the cam ring 44. FIG. 8 is a cross-sectional view taken along line 8-8 of FIG. 7. Because the turret 22 has rotated 90 degrees with respect to its previously illustrated orientation in FIG. 5, it can be seen that the securement extension 68 has a cross-sectional profile having a major dimension and a minor dimension. In some embodiments, the securement extension 68 (and the securement aperture 70) may have a rectangular cross-sectional profile. In other embodiments, the securement extension 68 may have any other desired cross-sectional profile such as a square profile.

In the illustrated embodiment, the turret 22 has a pair of spray tips 32 and 34 that are axially spaced apart and radially spaced about 90 degrees apart from one another. In some embodiments, the turret 22 may include three or more spray tips that may be axially spaced part and radially spaced apart, but not necessarily about 90 degrees apart. To illustrate, if the turret 22 has three spray tips, the three spray tips may be radially about 60 degrees apart, but this spacing is not required. It will be appreciated that the size and relative position of the projection 30 and the cam surface 48 may be altered to accommodate a desired number of spray tips and their relative axial and radial positions.

Figure 9:
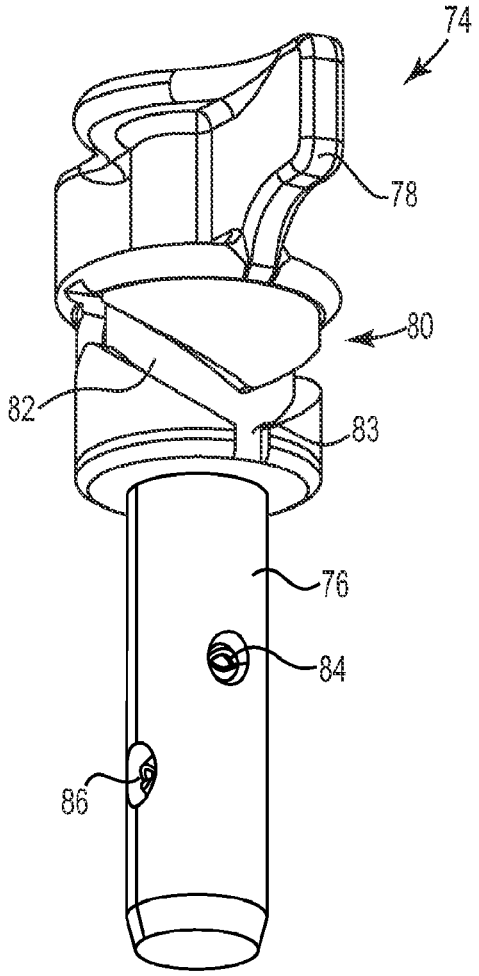
FIG. 9 is a perspective view of a turret according to another embodiment of the invention.
Figure 10:
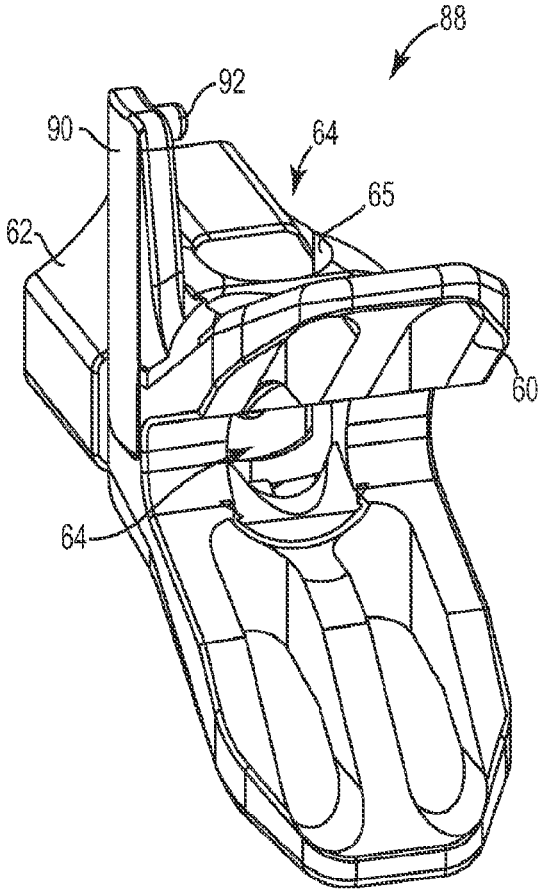
FIG. 10 is a perspective view of a tip holder according to another embodiment of the invention and for use with the turret shown in FIG. 9.
Figure 11:
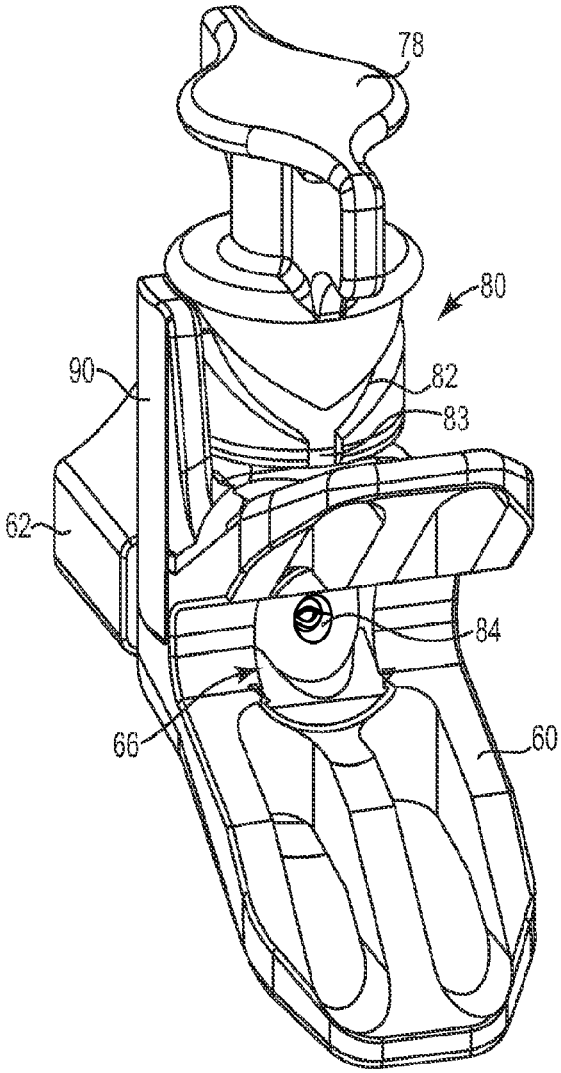
FIG. 11 is a perspective view illustrating the turret of FIG. 9 engaged in the tip holder of FIG. 10.

In the embodiment illustrated in FIGS. 1 through 7, the turret 20 includes the projection 30 (a cam follower) while the cam ring 44 includes the cam surface 48. In some embodiments, the relative locations of these elements may be reversed. For example, in some embodiments, projections or tabs may be formed in a tip holder while a complementary element such as a groove may be formed in a turret. FIGS. 9-11 illustrate an embodiment in which the tip holder includes a projection and the turret includes a complementary cam surface.

FIG. 9 is a perspective view of a turret 74 that includes a barrel 76, a handle 78, an engagement portion 80 and a helical groove 82 within the engagement portion 80. First and second spray tips 84 and 86 are mounted within the barrel 76. In some embodiments, as illustrated, the helical groove 82 includes a keyway 83 that permits insertion and/or removal of the turret 74 when appropriately radially aligned.

FIG. 10 is a perspective view of a tip holder 88 that may be used with the turret 74. In the illustrated embodiment, the tip holder 88 includes an extension arm 90 bearing a projection 92. The projection 92 fits into the helical groove 82 formed within the engagement portion 80 of the turret 74. Rotating the turret 74 relative to the tip holder 82 causes the projection 92 to slide within the helical groove 82 and thus cause the turret 74 to translate relative to the tip holder 88.

It will be appreciated that in some embodiments, the tip holder 88 may include a second, opposing, extension arm bearing a second projection. In some embodiments, the keyway 83 formed in the turret 74 may be useful in inserting the turret 74 into the tip holder 88, particularly if the tip holder 88 includes the aforementioned second extension arm.

FIG. 11 is a perspective view of the turret 74 disposed within the tip holder 88. Similar to the operation of the turret 22 discussed previously, rotating the handle 78 of the turret 74 causes the turret 74 to rotate and translate, thereby aligning a desired one of the spray tips 84 and 86 with a fluid spray passage (not illustrated) extending through the tip holder 88. In the illustrated orientation of the turret 74, it can be seen that the first spray tip 84 is aligned with the fluid spray path 66. It will be appreciated that by rotating the handle 78, and thereby rotating and translating the turret 74 relative to the tip holder 88, it is possible to align any spray tip within the turret 74 in either a spray position or a clean position.

In some embodiments, the extension arm 90 (and second extension arm, if present) is integrally formed with the tip holder 88. In some cases, the extension arm 90 (and second extension arm, if present) may be separately formed as a clip element that snaps onto the tip holder 88.

Figure 12:
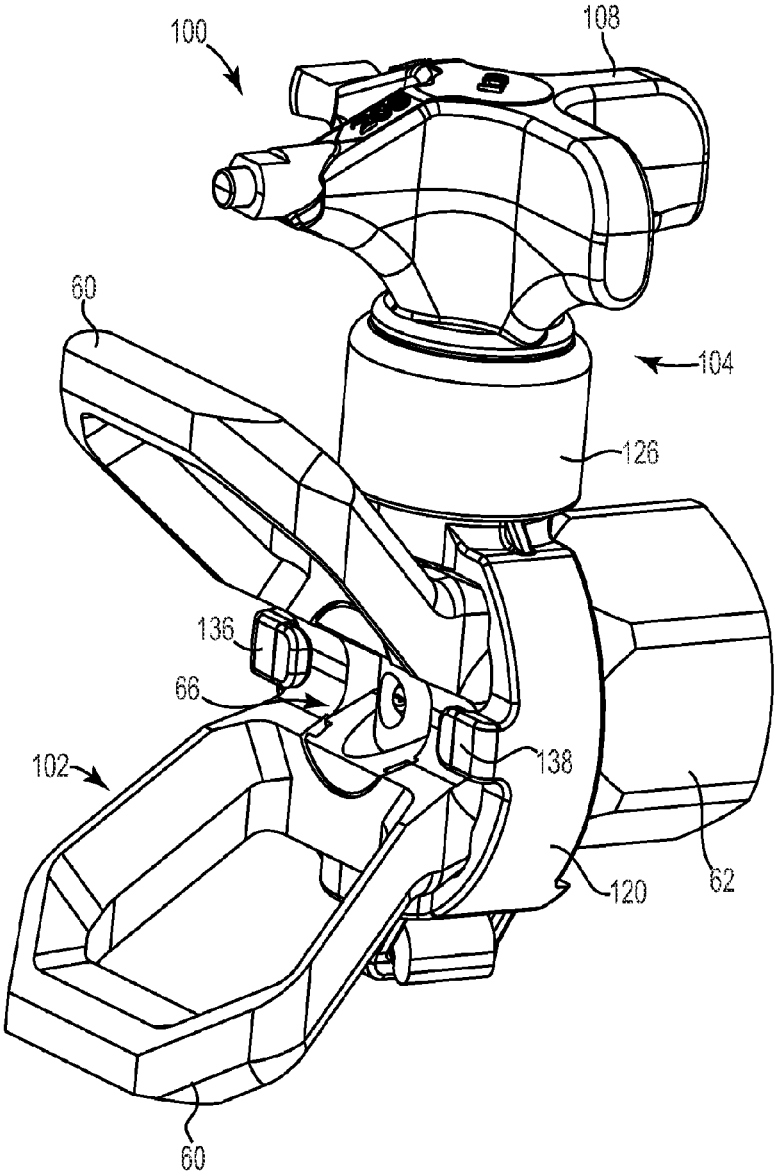
FIG. 12 is a perspective view of a tip holder and turret assembly according to yet another embodiment of the invention.
Figure 13:
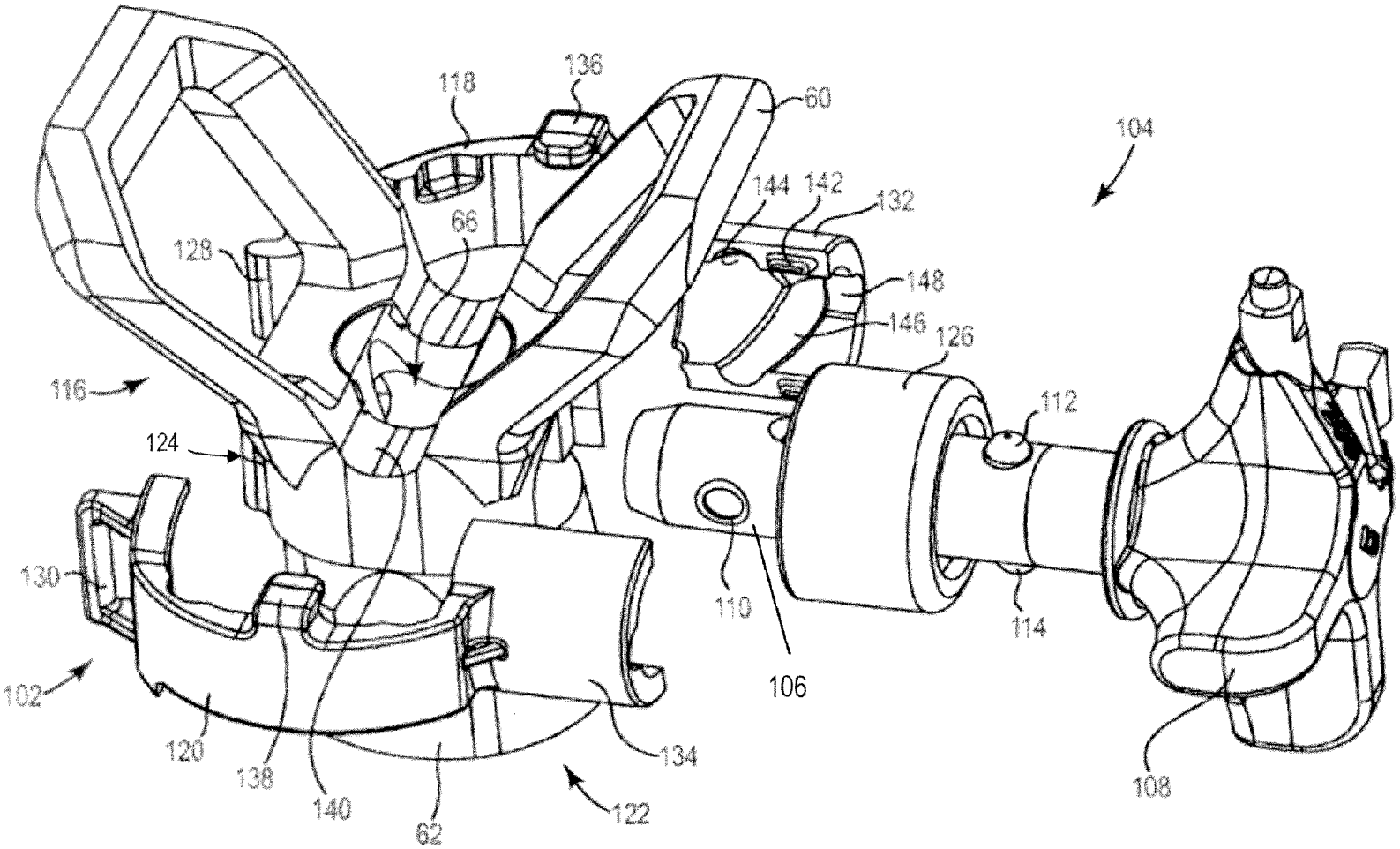
FIG. 13 is an exploded perspective view of the tip holder and turret assembly of FIG. 12.
Figure 14:
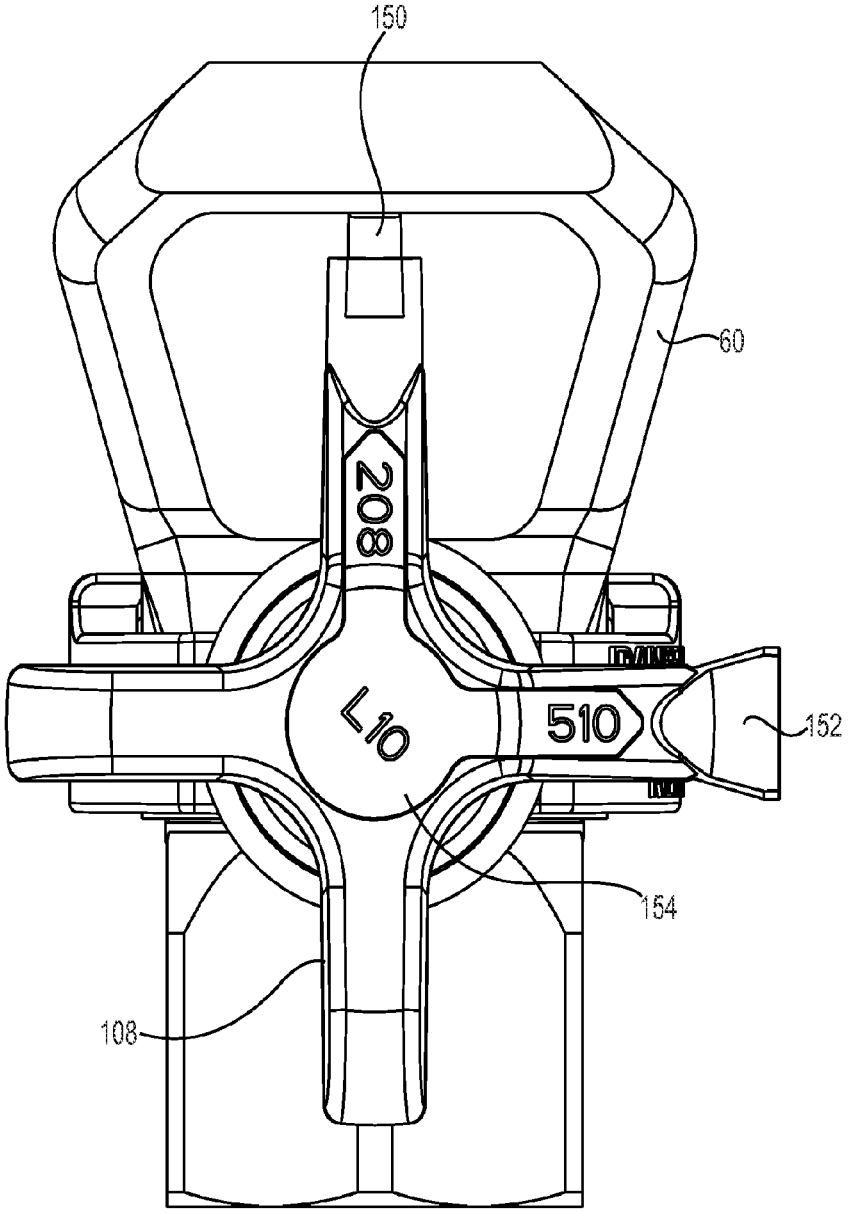
FIG. 14 is a back view of the tip holder and turret assembly of FIG. 12.

FIGS. 12 through 14 illustrate another embodiment of the invention in which the turret includes a projection and the tip holder includes structure that defines a cam surface with which the projection slidably engages to convert relative rotational movement of the turret into axial movement of the turret in order to move the turret between spray and clean positions of two or more spray tips that are disposed within the turret. In particular, FIG. 12 is a perspective view of a tip assembly 100 that includes a tip holder 102 and a turret 104 while FIG. 13 provides an exploded perspective view of the tip assembly 100.

The turret 104 includes a barrel 106 and a handle 108. In some embodiments, the barrel 106 and the handle 108 are integrally formed. In some embodiments, the handle 108 is separately formed and then subsequently joined together as discussed above with respect to the turret 22. The barrel 106 includes two or more spray tips that, as discussed above with respect to the turret 22, are disposed in through bores that are axially and rotationally spaced apart on the barrel 106. As illustrated, a single through bore 110 is visible. The turret 104 includes a pair of projections 112 and 114 that, as will be described, interact with a cam portion of the tip holder 102.

In some embodiments, the tip holder 102 includes a cam clamp 116 that provides a complementary engagement surface for the projections 112 and 114. In some embodiments, the cam clamp 116 extends around and engages a base 122 of the tip holder 102. In the illustrated embodiment, the cam clamp 116 includes a first clamshell portion 118 and a second clamshell portion 120. In some embodiments, the cam clamp 116 includes an interlock 124 that joins the first clamshell portion 118 and the second clamshell portion 120 at a first side of the base 122 as well as a ring lock 126 that joins the first clamshell portion 118 and the second clamshell portion 120 at a second side of the base 122.

In the illustrated embodiment, the interlock 124 is formed between a tab portion 128 on the first clamshell portion 118 and a complementary slot 130 in the second clamshell portion 120. In some embodiments, the interlock 124 may be formed using other structure, as desired. For example, the interlock 124 may include a through hole in both the first and second clamshell portions 118, 120 and a bolt or screw that passes therethrough. In some embodiments, the interlock 124 may be formed via a snap fit between an aperture in one clamshell portion and a corresponding peg in the other clamshell portion.

In some embodiments, as illustrated, the first clamshell portion 118 includes a first lock ring engagement surface 132 and the second clamshell portion 120 includes a second lock ring engagement surface 134. Once the tab portion 128 has been inserted into the slot 130, the first and second clamshell portions 118, 120 may be pivoted together and may be held together by placing the ring lock 126 onto the first and second lock ring engagement surfaces 132, 134. In some embodiments, the ring lock 126 may be held in place via a frictional fit. In some embodiments, the ring lock 126 may be threadedly engaged with the first and second lock ring engagement surfaces 132, 134.

In some embodiments, as illustrated, the first clamshell portion 118 includes a first tab 136 and the second clamshell portion includes a second tab 138 that engage with a surface 140 on the tip holder 102 to further locate and secure the cam clamp 116 to the tip holder 102. In some embodiments, the first clamshell portion 118 includes one or more alignment tabs 142 that align with corresponding apertures (not visible) in the second clamshell portion 120.

The cam clamp 116 also includes a cam surface that engages with the projections 112, 114 of the turret 104. The first clamshell portion 118 includes a first groove 144, a second groove 146 and a keyway 148 that extends into the first groove 144 and the second groove 146. The keyway 148 permits insertion of the turret 104 into the tip holder 102 so that the first and second projections 112, 114 may slideably engage the first and second grooves 144, 146. It will be appreciated that rotating the turret 104 will cause the turret 104 to both rotate and translate relative to the tip holder. As a result, a user may select a desired spray tip by rotating the handle 108. It will be appreciated that by rotating the handle 108, and thereby rotating and translating the turret 104 relative to the tip holder 102, it is possible to align any spray tip within the turret 104 in either a spray position or a clean position.

In some embodiments, as best illustrated in FIG. 14, the handle 108 may include indicia that provides the user with a visual confirmation of which spray tip is positioned for use. As discussed previously with respect to the turret 22, a user may wish to select between a first spray tip having a narrow spray pattern and a second spray tip having a wider or broader spray pattern. In some embodiments, the handle 108 may include a first marker 150 that is aligned with a first spray tip as well as a second marker 152 that is aligned with a second spray tip.

As shown, the first marker 150 has a different shape than the second marker 152 in order to distinguish between alignment of the first spray tip and the second spray tip. It will be appreciated that the first spray tip and the second spray tip may have a clear position in which the spray tip is aligned 180 degrees from its spray position in order to clear blockages from the spray tip. In this instance, it will be appreciated that when a particular spray tip is in its clear position, the corresponding marker on the handle 108 will also be arranged 180 degrees from its spray position. In some embodiments, the handle 108 may include a removable insert 154 that may include further identifying information such as spray tip diameter and the like.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A reversible, multiple spray tip spray gun tip assembly, comprising:

a tip holder having a turret opening with a longitudinal axis and a fluid spray passage in communication with the turret opening, and further having a base;

a cam clamp extending around and engaging the base, wherein the cam clamp comprises a first clamshell portion and a second clamshell portion, and wherein the cam clamp includes an interlock that joins the clamshell portions to the clam clamp;

a turret having a barrel with a plurality of spaced apart spray tips positioned within the tip holder turret opening;

a handle on the turret to rotate the barrel within the turret opening;

one or more projections on one of either the tip holder or the turret; and a cam surface on the other of the tip holder or the turret, the one or more projections slidably engaged with the cam surface such that rotating the turret relative to the tip holder causes the turret to axially translate relative to the tip holder and to align each of the spray tips with the fluid spray passage in a spray position and a clear position, wherein the cam surface is on the cam clamp, and wherein the cam clamp provides a groove that permits insertion of the turret into the tip holder.

2. The spray gun tip assembly of claim 1, wherein the one or more projections are on the tip holder.

3. The spray tip assembly of claim 1, wherein the one or more projections are on the turret.

4. The spray gun tip assembly of claim 1, wherein the cam surface includes at least one of a ramp surface and a groove.

5. The spray gun tip assembly of claim 1, further including stop structures to releasably position the turret with the spray tips at the spray and clear positions.

6. The spray gun tip assembly of claim 5, wherein the stop structures include recesses in the cam surface that cooperate with the one or more projections.

7. The spray gun tip assembly of claim 1, wherein the handle includes identifying structures to identify the location of the handle when the spray tips are in the spray and clear positions.

8. The spray gun tip assembly of claim 1 wherein:

the cam surface extends 360° about the turret opening, and the barrel is rotatable 360° in the turret opening.

9. The spray gun tip assembly of claim 1 wherein the cam clamp includes:

first and second clamshell sections;

an interlock joining the first and second clamshell sections on a first side of the base; and a ring lock joining the first and second clamshell sections on a second side of the base.

10. A reversible, multiple spray tip turret assembly for use in a spray gun tip assembly of the type having a tip holder base with a turret opening and a fluid spray passage in communication with the turret opening, the turret assembly comprising:

a turret including:

a barrel having a plurality of spaced apart spray tips and configured for rotatable movement within the tip holder base turret opening;

one or more projections; and a handle to rotate the barrel;

wherein rotation of the turret relative to the tip holder causes the turret to axially translate relative to the tip holder; and a cam engaging the tip holder base and having a cam surface that cooperates with the one or more projections of the turret to locate the barrel at a spray position and a clear position with respect to the fluid spray passage for each of the spray tips, and to guide the barrel about a longitudinal axis of the turret opening to the spray and clear positions during rotation of the barrel; and wherein the cam includes a cam clamp extending around and engaging the tip holder base, wherein the cam clamp comprises a first clamshell portion interlocked with a second clamshell portion, wherein the first clamshell portion of the cam clamp is engaged to the base at a first side, wherein the second clamshell portion of the cam clamp is engaged to the base at a second side, and wherein the cam surface is on the cam clamp.

11. The spray tip turret assembly of claim 10 wherein:

the cam extends 360° around the barrel and the cam surface extends 360° around the cam; and the barrel is rotatable about 360° with respect to the cam.

12. The spray tip turret assembly of claim 11 wherein:

the barrel includes two generally perpendicularly oriented spray tips; and the spray and clear positions of the spray tips are spaced apart by 90°.

13. The spray tip turret assembly of claim 11, wherein the cam surface extends through two high points located about 180 degrees apart and two low points located about 180 degrees apart, and the two low points are offset about 90 degrees from the two high points.

14. The spray tip turret assembly of claim 13, wherein the two high points comprise detents to releasably locate the turret.

15. The spray tip turret assembly of claim 12 wherein the spray and clear positions for each spray tip are offset by 180 degrees.

16. The spray tip turret assembly of claim 10 and further including stop structures to releasably position the turret with the spray tips at the spray and clear positions.

17. The spray tip turret assembly of claim 16 wherein the stop structures include recesses in the cam surface for releasably retaining the one or more projections at the spray and clear positions.

18. The spray tip turret assembly of claim 10, wherein the cam surface includes at least one of a ramp surface and a groove.

19. The spray tip turret assembly of claim 10, wherein the handle includes identifying structures to identify the location of the handle when the spray tips are in the spray and clear positions.

20. The spray tip turret assembly of claim 10 wherein the cam clamp includes:

first and second clamshell sections;

an interlock joining the first and second clamshell sections on a first side of the base; and a ring lock joining the first and second clamshell sections on a second side of the base.

21. The spray tip turret assembly of claim 10 wherein the cam includes a cam ring engaging the base.

* * * * *